US006446845B1

(12) United States Patent
Steiger

(10) Patent No.: US 6,446,845 B1
(45) Date of Patent: Sep. 10, 2002

(54) DISPENSING DEVICE FOR A LIQUID CONTAINER

(75) Inventor: Arthur Steiger, Uetikon am See (CH)

(73) Assignee: Kunststoffwerk & Formenbau Arthur Steiger AG, Uetikon am See (CH)

( * ) Notice: Subject to any disclaimer, the term of this patent is extended or adjusted under 35 U.S.C. 154(b) by 0 days.

(21) Appl. No.: 09/763,099

(22) PCT Filed: Aug. 19, 1999

(86) PCT No.: PCT/EP99/06078

§ 371 (c)(1),
(2), (4) Date: Feb. 16, 2001

(87) PCT Pub. No.: WO00/10908

PCT Pub. Date: Mar. 2, 2000

(30) Foreign Application Priority Data

Aug. 21, 1998 (DE) ..... 198 37 947

(51) Int. Cl.[7] ..... B65B 35/56

(52) U.S. Cl. ..... 222/509; 222/518; 222/105; 222/505; 251/319; 251/339

(58) Field of Search ..... 222/105, 505, 222/509, 511, 518, 544, 559; 251/319, 539, 342, 347

(56) References Cited

U.S. PATENT DOCUMENTS 2,324,648 A * 7/1943 Roeder ..... 222/509
2,373,294 A * 4/1945 Cornelius ..... 251/319
2,764,385 A * 9/1956 Sieling ..... 222/559
3,448,897 A * 6/1969 Sterling ..... 222/105
3,868,050 A * 2/1975 Gorychka et al. ..... 222/509
4,440,316 A * 4/1984 Christine ..... 222/518

FOREIGN PATENT DOCUMENTS

| | | |
|---|---|---|
| DE | 1 550 595 | 10/1969 |
| DE | 7340692 | 5/1974 |
| DE | 7403450 | 5/1974 |
| DE | 30 28 547 | 2/1981 |
| EP | 0 043 698 | 1/1982 |
| EP | 0 432 070 | 6/1991 |
| EP | 0 553 956 | 8/1993 |

* cited by examiner

*Primary Examiner*—J. Casimer Jacyna
(74) *Attorney, Agent, or Firm*—Bachman & LaPointe, P.C.

(57) ABSTRACT

The invention relates to a dispensing device for a liquid container, notably for a container made of a flexible material housed in a substantially dimensionally stable outer container which encloses same and is penetrated by the dispensing device. Said dispensing device comprises a tubular part with an outlet opening which can be shut by a valve element. A tubular housing body is closed at one end by a membrane-like front disk in which a rod-like transverse element in which a valve tappet for a valve head originates which is assigned to the lateral outlet opening provided for in the tubular housing body. The valve tappet and valve head further form a monobloc unit made a plastic material which is softer than the material of the housing body or rod-like element, and the valve tappet is mounted on the rod-like element in the area of an articulated region.

19 Claims, 2 Drawing Sheets

DISPENSING DEVICE FOR A LIQUID CONTAINER

BACKGROUND OF THE INVENTION

The invention concerns a dispensing device for a liquid container—in particular for a container of flexible material in a substantially dimensionally stable outer container which encloses the container of flexible material and is penetrated by the dispensing device—, wherein a tubular part of the dispensing device has a laterally disposed outlet opening which can be closed by a valve element.

Combinations comprising a dimensionally stable outer container and an inner container of flexible material which is accommodated therein are known for storing liquid foodstuffs such as wine, salad oil or the like. The outer container which is for example of a cuboidal or parallelepipedic shape can comprise corrugated card and its inner container can be of a bag-like configuration consisting of heat-sealed plastic foil or sheet. Such systems are also referred to as 'bag-in-box' containers.

In an opening in the inner container, a flange collar of a hollow coupling portion which is formed from plastic material can be welded to the inner container in liquid-tight and gas-tight relationship. Usually, pressed into that coupling portion is a tap or faucet or a bung; while the bung is pulled out for dispensing liquid, the re-closable tap for that purpose includes a valve element which is associated with the cross-section of an outlet opening.

For transport purposes, the tap is disposed within the outer container and, prior to being opened, is pulled through a pre-perforated portion of the outer container. In order in that situation to prevent unwanted actuation of the valve element the tap can additionally be provided with a seal. When the liquid flows out the flexible inner container collapses, that is to say its volume always matches the amount of liquid which is stored therein and oxidation processes due to air subsequently flowing thereinto therefore do not occur.

An aspect of significance in regard to taps or faucets of that kind is the sealing integrity thereof with respect to the ambient atmosphere; if the latter penetrates into the liquid container, the shelf life of liquid foodstuffs, for example wine stored in the inner bag, is considerably reduced. It will be appreciated that the sealing integrity of a tap made from plastic material is reduced reciprocally to the number of joins that it involves.

Besides a good flow speed for the container contents, the properties required of a tap of the described kind are that it should be simple to keep clean and that it should be of a configuration which facilitates injection molding.

A dispensing device of the kind set forth in the opening part of this specification is disclosed in EP 0 043 698 A1.

Here the valve element is a plug-like body on a pressure plate which is displaceable in the housing body; the pressure plate is connected by a rod-shaped intermediate element which in the closed position of the valve element extends substantially parallel to the longitudinal axis of the housing body, to a spherical portion of elastic material, as an actuating member arranged at the front end of the housing; that spherical portion is clampingly fixed by its edge to the housing body and deformed upon actuation of the intermediate element.

EP 0 553 956 A1 describes another dispensing device whose actuating member is also a pressure spherical portion which is fixed at one end to a housing body. Projecting substantially axially from the pressure spherical portion is a sliding pin which affords a sliding cam and which at its inner end includes a cylinder body having a sawtooth edge, as a penetration element, and whose sliding cam co-operates with the bar end of a valve element at the lateral outlet opening.

Rotational elements are unsuitable for so-called bag-in-box systems as the flexible inner container does not offer a sufficient resistance to turning movement. To open such a tap the tap or its coupling portion has to be held fast with one hand while the other hand is used to operate the valve element. A rotary tap with a valve cover which is rotatable by hand is to be found for example in DE 39 10 425 A1. Taps which can be opened and held at the same time with one hand are more suitable for a bag-in-box; in that way, the other hand remains available for firmly holding a vessel which is to be filled.

In order to keep the inner container free of oxygen before the first use of the inner container, the above-mentioned opening in the inner container can be closed by a plate or a plug which is removed before the first use occurs. There are also taps which, in addition to the valve element, also have a device for piercing the plate or for removing the plug from the opening in the container. In that case, the valve element can be connected to the piercing device, in which respect attention is directed to DE 32 12 232 A1. The latter describes a tap having a valve element and a closure device, in which the valve element and a plug of the closure device are arranged in coaxial successive relationship. Upon actuation of a resilient knob the valve element is removed from its valve seat; the tap opens as a result. In addition the valve element urges the plug towards the outlet and the opening in the container is opened.

EP 0 432 070 A discloses a tap having a housing body and a plunger which is loaded by a force-storage means. The plunger acts on a sealing diaphragm connected to the housing body.

The dispensing devices available hitherto for the bag-in-box systems are generally of a complicated and expensive design configuration and comparatively large amounts of plastic material are required for shaping them. Those dispensing devices are excessively cost-intensive both in terms of their manufacture and also in terms of stockkeeping. In addition, gas-tight sealing integrity is still defective; the taps available on the market include a large number of soft parts; however, they perceptibly reduce the gas-tight sealing integrity while involving a low level of resistance to deformation under the effect of heat.

In consideration of that state of the art the object of the present invention is to simplify a dispensing device for liquid containers of flexible material, in particular for wine containers of bag-in-box systems, in regard to the design configuration thereof, and to enhance their gas-tight sealing integrity. The invention also seeks to provide that the amount of plastic material used is reduced and handleability and cleanability are improved.

SUMMARY OF THE INVENTION

In accordance with the invention a tubular housing body is closed at one end by a diaphragm-like front disk and supported therein is a rod-like element which passes therethrough and from which extends a valve tappet for a valve head which is associated with the outlet opening provided laterally in the tubular housing body. The valve tappet and the valve head should advantageously form a shaped or molded unit comprising plastic material which is softer than the housing body or the rod-like element—for example polyethylene—; the valve tappet is supported on the rod-like element in the region of a pivot location. The rod-like element and the housing body are preferably formed from polypropylene.

In accordance with a further feature of the invention, in the closed position of the valve head, the above-mentioned rod-like element extends substantially parallel to the longitudinal axis of the housing body and can be pivoted therefrom towards the outlet opening, with temporary deformation of the front disk, for which purpose outside the housing body it is advantageously in the form of a kind of press key body, that is to say it affords a pressing surface for a finger or the like. In order to predetermine the pivotal movement of the rod element, formed on the key body in accordance with the invention at the rear thereof is an abutment element which in the closure position is disposed at a spacing relative to a mounting tongue or the like profile element, which projects from the face of the housing body. That helps a user to implement the pivotal movement by means of two fingers.

For that purpose, the mounting tongue can be associated with the peripheral region of the housing body, which is in diametrally opposite relationship to the outlet opening, that is to say, the two gripping fingers pivot the inner portion of the rod element towards the outlet opening—for that purpose the valve head is associated with an edge or tubular outlet portion surrounding the outlet opening at the outside of the housing body and is guided away therefrom.

If the mounting tongue is associated with or formed on the peripheral region of the housing body, which is adjacent to the outlet opening, the two fingers pivot the inner portion of the rod element away from the outlet opening, and for that reason, in this case, the valve head is associated with the edge or tubular outlet portion surrounding the outlet opening at the inside of the housing body, and can be lifted off towards the longitudinal axis of the housing body away from the tubular outlet portion or the like.

Accidental actuation of the valve during transportation or the like is prevented by the key body being connected at the front end to at least one securing tongue portion and by the latter being connected at the other end to the housing body and/or its front disk; the securing tongue portion can advantageously be formed on the one hand on the key body and on the other hand on the front disk in each case by means of at least one molded strip.

It is only after the molded strips have been severed that the key body can be pivoted.

If there is a wish to keep the outlet opening in an opened condition, independently of the hand of the user, attached to or formed on the key body is an at least partially flexible elongate molded portion which extends from the key body and which has a detent body at the end thereof; in the open position of the valve element and when the rod-like element is in an inclined position, the elongated molded portion is pushed into an edge opening of the mounting tongue in such a way that its detent body can be laid on the outside surface of the mounting tongue. The position of the key body—and therewith the valve—is established and fixed thereby.

It has proven desirable for the outlet portion which surrounds the outlet opening to be formed out of the housing body at an angle relative to the longitudinal axis of the housing body, preferably at an angle of about 75° C. in that way the outlet opening is more easily accessible. If moreover the outlet portion is provided with a male screwthread, a hose can be fixed thereto as a permanent conduit.

At a spacing relative to the outlet opening the housing body is provided with a radial flange collar as an abutment element for an annular body of a push-on flange which can be pushed on to the housing body. The flange is sealingly fixed, for example welded, to the inner container by means of an end annular flange delimiting an opening through the liquid container, and forms the coupling portion thereof for the housing body. The latter and the push-on flange in the position of use are sealingly connected in mutually detent relationship by radially acting retaining pairings—on the one hand peripheral grooves and on the other hand peripheral beads which can be fitted thereinto.

BRIEF DESCRIPTION OF THE DRAWINGS

Further advantages, features and details of the invention will be apparent from the description hereinafter of preferred embodiments and will reference to the drawing in which:

FIGS. 5 and 6 are partly sections through regions of the plastic tap.

DETAILED DESCRIPTION

Disposed in a parallelepipedic outer or packaging container 10 which is made from corrugated cardboard or the like is a liquid container which is only indicated at 12 and which is of a bag-like configuration and which comprises heat-welded plastic foil or sheet with an outer coating of an aluminum layer. That flexible inner or liquid container 12 is provided in the region of an opening indicated in FIG. 2 with a tap 14 which passes through the packaging container 10. For example a wine carafe 16 can be filled with the contents of the container by virtue of the tap 14. It will be appreciated that this so-called 'bag-in-box' may also contain industrial liquid or the like.

Figure 2:
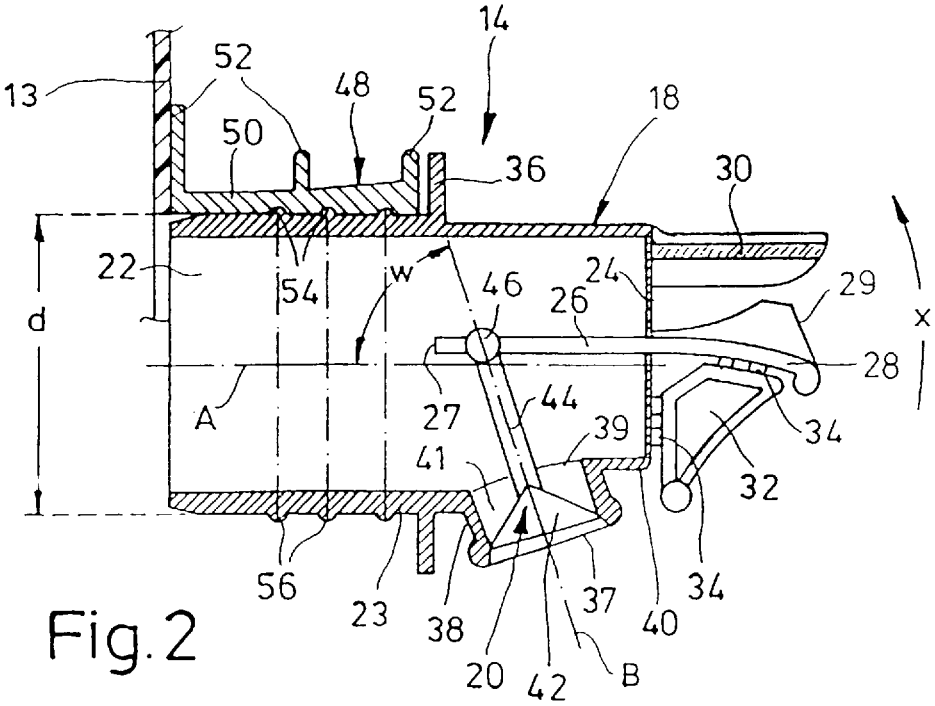
FIGS. 2 and 4 show cross-sections through two embodiments of the plastic tap.

Referring to FIG. 2, the tap 14 is composed of two parts which are each produced separately, more specifically a housing body 18 which is formed from polypropylene and a valve element 20 of polyethylene. The housing body 18 includes a cylindrical tube 20 of an outside diameter d and a diaphragm-like front disk 24 which closes the cylindrical tube 22 at one end.

Figure 1:
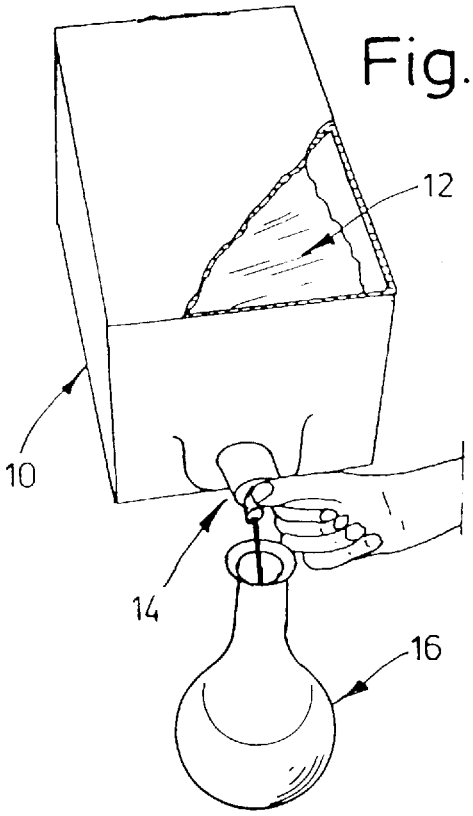
FIG. 1 is a perspective view of a wine container with a plastic tap for emptying the container.
Figure 3:
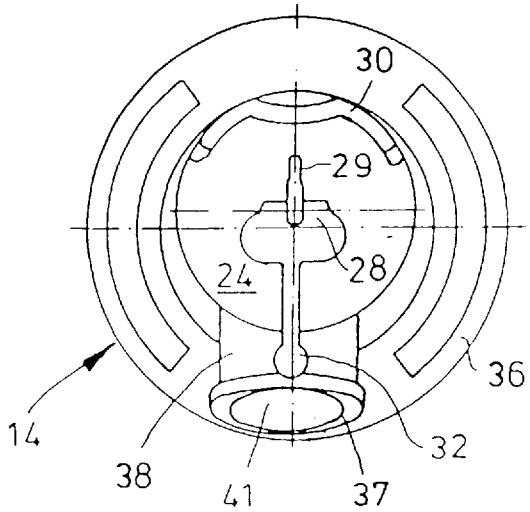
FIGS. 3 and 5 show end views on to FIG. 2 and FIG. 4 respectively.

Extending substantially on the longitudinal axis A of the cylindrical tube 22 is a rod 26 for the valve element 20; the rod 26 passes through the front disk 24 and outside the front disk 24 forms a kind of push key body 28 and carries an upwardly directed abutment leg 29 or the like portion formed thereon. Disposed opposite the key body 28 is a mounting tongue 30 which projects in an arm-like configuration from the front disk 24 and which is of a wave-like configuration in cross-section as can be seen from FIG. 3.

FIG. 2 shows a securing tongue portion 32 which is approximately triangular in side view and which connects the key body 28 before first use of the tap 14 to the housing body 18 by means of molded strips 34 by way of the securing tongue portion 32, and thus prevents accidental actuation; it is only after the securing tongue portion 32 has been cut off that it is possible to apply to the surface of the key body 28 a finger of a hand (not shown) for actuating the arrangement, for example in this case the index finger. When the thumb of the hand is applied to the mounting tongue 30, the key body 28 can be pulled in the direction of the arrow x without any difficulty and thus the valve element 20 can be actuated. In that situation, the abutment leg 29 prevents excessive diffraction movement of the key body 28 when, in the last movement, it meets the inward side of the mounting tongue 30.

Near the front disk 24, between the front disk and a flange collar 36 which is shaped radially on the cylindrical tube 22, formed out of the cylindrical tube 22 is an outlet portion 38 which defines an outlet opening and whose longitudinal axis B delimits an angle w of about 75° with the longitudinal axis A of the tube 22. The wall of the tube is drawn in at 40—towards the longitudinal axis A—between the outlet portion 38 and the front disk 24; that region of the housing body 18, which is the lower region in FIG. 2, is therefore of a smaller radius $r_1$ than the region which is the upward region here, of the radius r.

In its internal space 41 which is delimited upwardly by an inner edge 39 and forms an outlet opening, the outlet portion 38 accommodates a valve head 42 which is pivotally connected to the rod 26 at 46 or is fitted thereinto, near the free end 27 of the rod 26, by means of a valve tappet 44 which is formed on the valve head 22 and which forms therewith as a shaped unit the valve element 40; the unit consisting of the valve head 42 and the valve tappet 44 is produced separately and then fitted to the rod 26.

The foil or sheet 13 forming the liquid container 12 is connected in the region of the above-mentioned opening therein to a push-on flange 48 which is pushed on to the cylindrical connection portion 23 at the left in FIG. 2, and clamped fast thereon. The push-on flange 48 comprises an annular body 50 with annular flanges 52 formed radially on the outside thereof; internal annular grooves 54 of the annular body 50 in this arrangement receive outer annular beads 56 on the connection portion 23.

Figure 4:
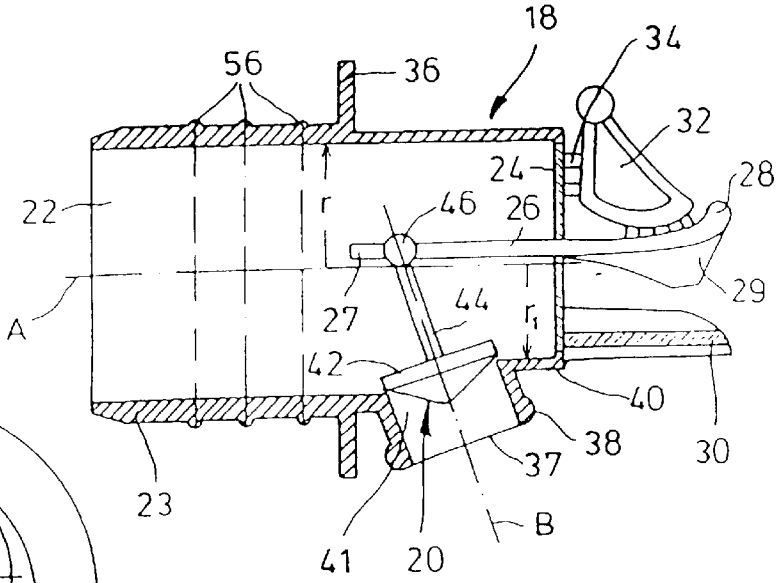
Figure 5:
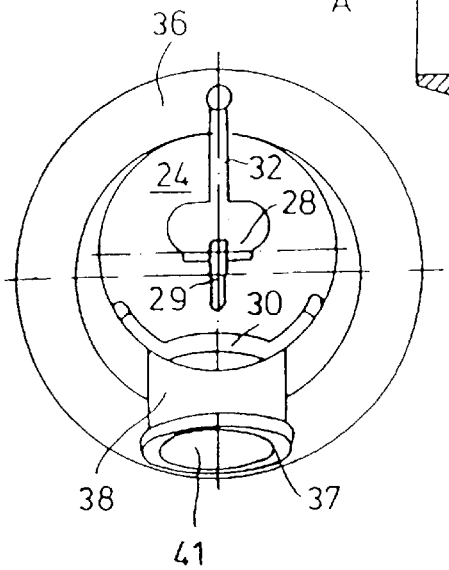

In the embodiment shown in FIGS. 4 and 5, the mounting tongue 30 is mounted to the peripheral region of the housing body 18, which is near the outlet portion 38; in this case, a user uses the thumb to apply pressure to the key body 18 while the associated index finger engages under the mounting tongue 30. Here the valve head 42, in the illustrated rest position, bears against the inner edge 39 of the outlet portion 38 whereas in the embodiment shown in FIGS. 2 and 3, it is disposed at the outer edge 37 of the outlet portion 38. In both cases the valve head 42 is lifted away from the internal space 41 in the outlet portion.

Figure 7:
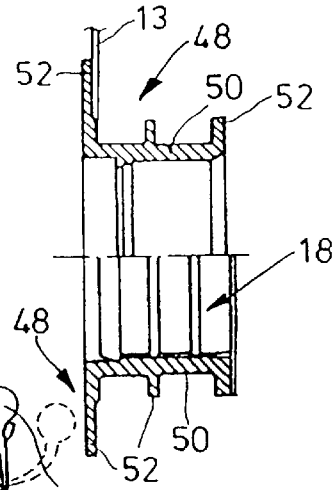
FIG. 7 is a detail from FIG. 2 in a modified embodiment.
Figure 6:
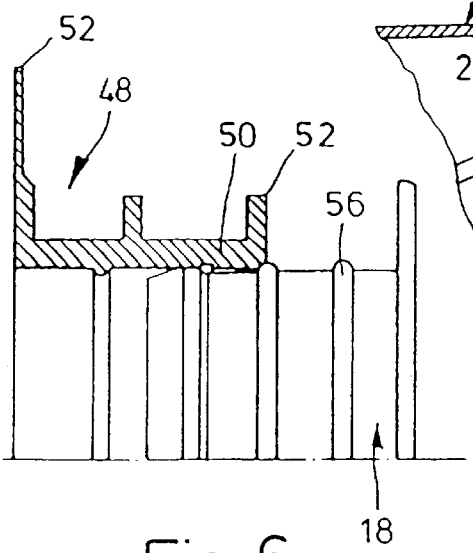
Figure 9:
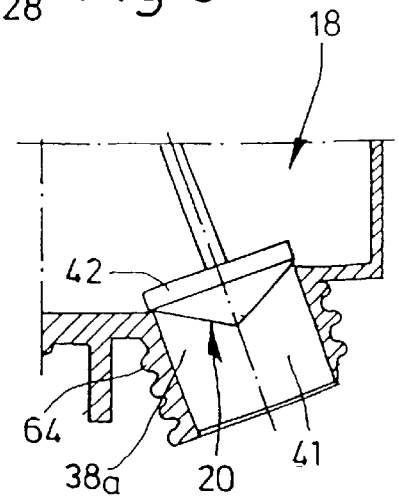

FIGS. 6 and 7 show various connecting locations between the liquid container 12 or the sheet or foil 13 thereof, the push-on flange 48 connected thereto on the one hand, and the tap 14 or its housing body 18 on the other hand.

Figure 8:
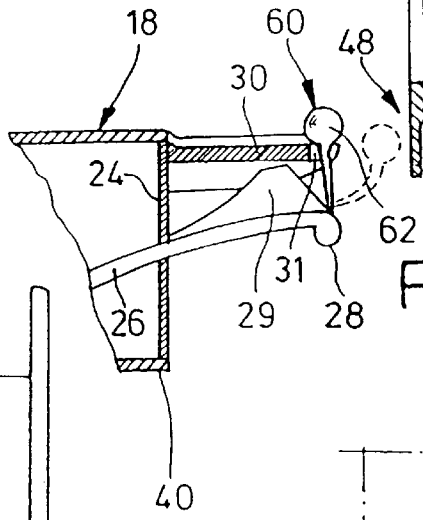
FIG. 8 is a part on an enlarged scale from FIGS. 2 and 4 in a further embodiment.

As shown in FIG. 8, provided on the key body 28 is a flexible fixing element 60 in the form of an elongate portion, for example a plastic thread which terminates in a ball 62 as a retaining detent body; in the open position of the valve element 20, the plastic thread is fitted into an edge slot 31 in the mounting tongue 30, with the ball 62 being supported against the outside surface of the mounting tongue 30 and holding the valve element 20 in the open position. That is of significance for example when the liquid container 12 is to be emptied steplessly or when it is connected to a hose system with the integrated closing element; for the last-mentioned case, a male screwthread 64 can be formed in the outlet portion $\mathbf{38}_a$.

What is claimed is:

1. A dispensing device for a liquid container (12), for a container of flexible material in a substantially dimensionally stable outer container (10) which encloses same and is penetrated by the dispensing device, wherein a tubular housing body (18) of the dispensing device has a laterally disposed outlet opening (14) which can be closed by a valve element and the valve element is connected by an elongated intermediate element (26) which in the closed position of the valve element (42) extends substantially parallel to the longitudinal axis (A) of the housing body (18) to an actuating member (28) arranged at the housing front end, characterised in that the tubular housing body (18) is closed at one end by a diaphragm-like front disk (24) and mounted in the front disk is a rod-like intermediate element (26) which penetrates therethrough and which is provided at one end with the actuating member (28) and from which at the other end extends a shaped unit with a valve tappet (44) and a valve head (42) which is associated with the laterally disposed outlet opening (41) and comprising plastic material which is softer than the housing body (18) or the rod-like element (26) wherein the intermediate element is adapted to be deflectable out of the closed portion relative to the outlet opening (41) with temporary deformation of the front disk (24).

2. A device as set forth in claim 1, characterised in that a portion of the rod-like element, which portion extends outside the housing body (18), forms a press key body (28) as the actuating member.

3. A device as set forth in claim 2, characterised in that formed on the key body (28) on the rear side thereof is an abutment element (29) which in the closed position is at a spacing relative to a mounting tongue (30) or the like profile element, which projects from the front end of the housing body (18), wherein the mounting tongue is preferably associated with the peripheral region of the housing body (18), which is in diametrally opposite relationship to the outlet opening (41) or is associated with the peripheral region of the housing body (18), which is adjacent to the outlet opening (41).

4. A device as set forth in claim 3, characterised in that the valve head (42) is associated with an edge or outlet portion **(38, 38*a*) surrounding the outlet opening (41), at the outside of the housing body (18)**.

5. A device as set forth in claim 3, characterised in that the valve head (42) is associated with an edge or outlet portion **(38, 38*a*) surrounding the outlet opening (41), at the inside of the housing body (18)**.

6. A device as set forth in claim 3, characterised in that at the front the key body (28) is connected to at least one securing tongue portion (32) and same is connected at the other end to the housing body (18) and/or the front disk (24) thereof.

7. A device as set forth in claim 6, characterised by a securing tongue portion (32) which is formed on the key body (28) on the one hand and the front disk (24) on the other hand in each case by at least one molded strip (34).

8. A device as set forth in claim 7, characterised in that attached to the key body (28) is an at least partially flexible elongate molded portion which extends therefrom and which has a detent body (62) at the end, wherein in the open position of the valve element (20) and with the rod-like element (26) in an inclined position, the elongate molded portion can be fitted into an edge opening (31) of the mounting tongue (30) in such a way that the detent body bears against the outside surface of the mounting tongue.

9. A device as set forth in claim 8, characterised in that the valve head (42) is associated with an outlet portion **(38, 38*a*)**

and the outlet portion (38, 38*a*) surrounds the outlet opening (41) and extends inclinedly at an angle (w) relative to the longitudinal axis (A) of the housing body (18), wherein the angle (w) preferably measures about 75°.

10. A device as set forth in claim 9, characterised in that the region of the periphery of the housing body (18), which region extends between the outlet portion (38, 38*a*) and the front disk (24), is of a shorter radius ($r_1$) than the other cross-sectional region of the housing body.

11. A device as set forth in claim 9, characterised in that the outlet portion ($\mathbf{38}_a$) is provided with a male screwthread (64).

12. A device as set forth in claim 1, characterised in that a flange collar (36) projects radially from the housing body (18) at a spacing relative to the outlet opening (41), as an abutment element for an annular body (50) of a push-on flange (48), which annular body (50) can be pushed on to the housing body.

13. A device as set forth in claim 12, characterised in that the push-on flange (48) and the housing body (18) are sealingly connected in detent relationship with each other by radially acting retention pairings (54, 56).

14. A device as set forth in claim 13, characerised in that an end annular flange (52) of the push-on flange (48) is fixedly connected to the liquid container (12) defining an opening therethrough.

15. A device as set forth in claim 1, characterised in that the valve tappet (44) of the valve head (42) is mounted to the rod-like intermediate element (26) in the region of a pivot location (46).

16. A device as set forth in claim 15, characterised in that the housing body (18) is formed from polypropylene.

17. A device as set forth in claim 15, characterised in that the shaped unit (20) comprising the valve head (42) and the valve tappet (44) is formed from polyethylene.

18. A dispensing device for a liquid container, for a container of flexible material in a substantially dimensionally stable outer container which encloses same and is penetrated by the dispensing device, wherein a tubular part of the dispensing device has an outlet opening which can be closed by a valve element, characterised in that a tubular housing body (18) is closed at one end by a diaphragm-like front disk (24) and mounted in the front disk is a rod-like element (26) which passes therethrough and from which extends a valve tappet (44) for a valve head (42) which is associated with the outlet opening (41) provided laterally in the tubular housing body, wherein the valve tappet (44) and the valve head (42) form a shaped unit (20) comprising plastic material which is softer than the housing body (18) or the rod-like element (26), wherein the valve tappet is mounted to the rod-like element in the region of a pivot location (46).

19. A dispensing device for a liquid container, for a container of flexible material in a substantially dimensionally stable outer container which encloses same and is penetrated by the dispensing device, wherein a tubular part of the dispensing device has an outlet opening which can be closed by a valve element, characerised in that a tubular housing body (18) is closed at one end by a diaphragm-like front disk (24) and mounted in the front disk is a rod-like element (26) which passes therethrough and from which extends a valve tappet (44) for a valve head (42) which is associated with the outlet opening (41) provided laterally in the tubular housing body, wherein a flange collar (36) projects radially from the housing body (18) at a spacing relative to the outlet opening (41), as an abutment element for an annular body (50) of a push-on flange (48), which annular body (50) can be pushed on to the housing body, wherein the push-on flange (48) and the housing body (18) are sealingly connected in detent relationship with each other by radially acting retention pairings (54, 56).

* * * * *